US008028625B2

(12) United States Patent
Kim et al.

(10) Patent No.: US 8,028,625 B2
(45) Date of Patent: Oct. 4, 2011

(54) MISSILE SEPARATION DEVICE

(75) Inventors: Jai-Ha Kim, Daejeon (KR); Dong-Ju Lee, Daejeon (KR); Yang-Wook Hur, Daejeon (KR); Ki-Soo Bae, Daejeon (KR)

(73) Assignee: Agency for Defense Development, Daejeon (KR)

( * ) Notice: Subject to any disclaimer, the term of this patent is extended or adjusted under 35 U.S.C. 154(b) by 259 days.

(21) Appl. No.: 12/366,859

(22) Filed: Feb. 6, 2009

(65) Prior Publication Data

US 2010/0050897 A1 Mar. 4, 2010

(30) Foreign Application Priority Data

Aug. 29, 2008 (KR) ..... 10-2008-0085498

(51) Int. Cl.
*F42B 15/36* (2006.01)

(52) U.S. Cl. ..... 102/377; 89/1.14

(58) Field of Classification Search ..... 102/377, 102/378; 89/1.14, 1.1
See application file for complete search history.

(56) References Cited

U.S. PATENT DOCUMENTS

| | | | | |
|---|---|---|---|---|
| 4,171,663 | A | 10/1979 | Day et al. | |
| 4,291,931 | A | 9/1981 | Stupay | |
| 4,648,321 | A | 3/1987 | Lusk | |
| 4,719,858 | A | 1/1988 | Stiles | |
| 5,020,436 | A * | 6/1991 | Coburn | 102/377 |
| 5,046,426 | A | 9/1991 | Julien et al. | |
| 5,253,587 | A | 10/1993 | Thouron et al. | |
| 5,400,713 | A | 3/1995 | Humiston et al. | |
| 5,641,123 | A * | 6/1997 | Kishimoto et al. | 239/265.15 |
| 6,439,122 | B1 | 8/2002 | Nygren et al. | |
| 6,544,056 | B1 * | 4/2003 | Roth et al. | 439/161 |
| 6,622,971 | B1 * | 9/2003 | Robertson | 244/171.1 |

FOREIGN PATENT DOCUMENTS

| | | | |
|---|---|---|---|
| RU | 2239782 | C1 | 11/2004 |
| RU | 2244898 | C2 | 1/2005 |
| RU | 2323138 | C1 | 4/2008 |
| SU | 73468 | | 3/1946 |
| SU | 1749693 | A1 | 7/1992 |

OTHER PUBLICATIONS

Official Decision of Grant dated Apr. 6, 2010 for Russian Application No. 2009111184.

* cited by examiner

*Primary Examiner* — James Bergin
(74) *Attorney, Agent, or Firm* — Scully, Scott, Murphy & Presser, P.C.

(57) ABSTRACT

Disclosed is a device for separating a propulsion system from a missile, the device including a locking unit configured to fix a propulsion system to a missile, a string disposed to cross a rear portion of the propulsion system to be broken by heat of the propulsion system, and an unlocking unit configured to unlock the missile by the broken string, whereby the number of additional components of an unlocking system can be reduced as many as possible so as to simplify the configuration of the apparatus, resulting in guaranteeing an enhanced performance of the missile, an easy assembly of the missile, and a reduction of a fabricating cost.

7 Claims, 6 Drawing Sheets

MISSILE SEPARATION DEVICE

CROSS REFERENCE TO RELATED APPLICATIONS

The present application is related to, and claims priority to, Korean patent application 10-2008-0085498, filed on Aug. 29, 2008, the entire contents of which are incorporated herein by reference.

BACKGROUND OF THE INVENTION

1. Field of the Invention

The present invention relates to missile separation devices and more particularly to the device which separate a propulsion system from a missile.

2. Description of the Background Art

A missile is manufactured to be separated into plural stages for an efficient flying toward a designated point. A variety of separating devices for separating the stages of the missile have been developed. In particular, a missile system with a launcher requires a separation of a coupling system for connecting the missile when the missile is ejected in its launching direction.

Commonly-used typical separation mechanisms include a mechanism in which two stages of a missile are coupled by bolts and explosives mounted in the bolts are exploded at a preset time, thus to break the bolts for separation (U.S. Pat. Nos. 4,648,321 or 5,400,713), a band cutter adapting explosive bolts (U.S. Pat. No. 4,719,858), and the like. Such self-explosive pyrotechnic devices have been well known as opportunely performing the stage-separation of the missile at a process of launching a missile.

However, a considerable impact may occur upon the cutting operation and accordingly a great impact loading may be applied to components near the pyrotechnic device, thereby standing a chance of causing vital problems in precision components or optical systems. As one example, an electromagnetic interference (EMI) shielding is required for preventing the detonation of a weapon due to electromagnetic waves generated at the time of explosion. Also, even if the pyrotechnic device is very reliable, it is difficult to perform an electric test to a system of the pyrotechnic device once being installed, due to the dangerousness of electric or electromagnetic signals by which the pyrotechnic device can be detonated.

Next, in order to receive power required for the detonation of the pyrotechnic device, a battery overload may occur or battery capacity should be increased.

Furthermore, a technical solution is required for sufficiently protecting the pyrotechnic devices from an easily corroded environment, e.g., from moisture. In order to overcome such drawbacks, various schemes or devices have been proposed, including a method using a gas generator (U.S. Pat. Nos. 4,171,663 or 5,253,587), a parallelogram structure (U.S. Pat. No. 4,291,931), a device using wire or metallic foil as an electric fuse (U.S. Pat. No. 5,046,426), a device using a heating mechanism and complex cable (U.S. Pat. No. 6,439,122), and the like. However, such schemes and devices should be provided with separate equipment and even increase a minimum section area of a missile, resulting in the generation of drag, causing a degradation of performance of a missile or an increase in a fabricating cost. Furthermore, a system using a wire or metallic foil should be configured such that all of the wires and metallic foils are connected to an electric circuit, respectively, which makes the structure complicated, thereby lowering productivity and reliability of the system.

BRIEF DESCRIPTION OF THE INVENTION

In order to overcome the drawbacks, one object of the present invention is to provide an unlocking (separation) mechanism capable of ensuring a simplified design and an easy assembly of a missile and enhancing the performance of the missile by minimizing the number of additional members for separating the missile.

Another object of the present invention is to propose an efficient method capable of overcoming the drawbacks having the chance of being occurred upon using the related art pyrotechnic device, and cutting down a fabricating cost by adapting an unlocking (separation) mechanism.

Another object of the present invention is to enable such unlocking mechanism to be applied to separation and coupling devices of various systems in addition to research missiles and attack missiles.

To achieve these and other advantages and in accordance with the purpose of the present invention, as embodied and broadly described herein, there is provided an unlocking (separation) device for a propulsion system of a missile including: a locking unit configured to fix a propulsion system to a missile; a string disposed to cross a rear portion of the propulsion system to be broken by heat of the propulsion system; and an unlocking unit configured to unlock the missile by the broken string.

In one aspect of the present invention, the locking unit and the unlocking unit are formed as pairs at both sides of the propulsion system, and each unlocking unit is connected by the string.

In one aspect of the present invention, the locking unit include a missile fixing frame formed at a rear portion of the missile, a propulsion system fixing frame formed at the propulsion system, a fixing pin configured to couple the missile fixing frame to the propulsion system fixing frame, and a first spring supported between the missile and the propulsion system and disposed to apply an elastic force to a direction to unlock the propulsion system.

In one aspect of the present invention, the fixing pin is disposed to be perpendicular to the string.

In one aspect of the present invention, the missile fixing frame and the propulsion system fixing frame are configured to be overlapped with each other, and pin holes, in which the fixing pin is inserted, are formed respectively in the corresponding overlapped sections between the missile fixing frame and the propulsion system fixing frame.

In one aspect of the present invention, the pin holes are configured as long holes extending in a direction of the string being disposed.

In one aspect of the present invention, the string is formed of a metal or plastic having a melting point as hard as being able to be melted by heat of the propulsion system.

In one aspect of the present invention, the unlocking unit includes a release latch having one side connected to the string, and installed to orbit with respect to the missile such that the fixing pin is slipped out of the pin holes when the string is broken, and a second spring supported between the missile and the release latch, and configured to apply an elastic force to the release latch in the direction to separate the fixing pin.

In one aspect of the present invention, a rotational shaft of the release shaft is configured to be perpendicular to the string and the fixing pin, respectively.

In one aspect of the present invention, the fixing pin is provided with a pin body and a head portion having a diameter greater than that of the pin body, and key grooves for restricting the fixing pin in a moving direction of the release latch are formed in the pin body.

In one aspect of the present invention, the release latch comprises an open hole formed in a shape of 'c' so as to be engaged with the key grooves of the fixing pin.

DETAILED DESCRIPTION OF THE INVENTION

Hereinafter, description will be given in detail of a missile separation device according to the present invention with reference to the accompanying drawings.

Figure 1:
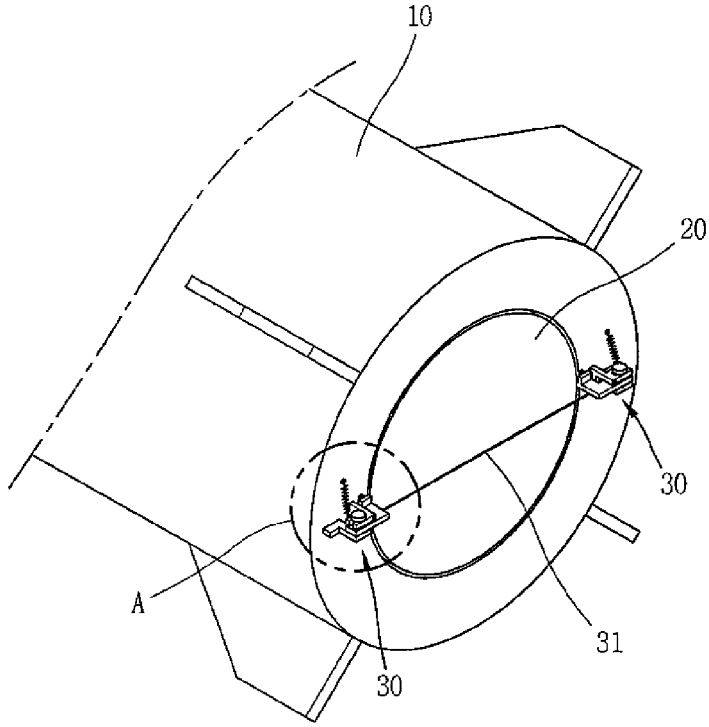
FIG. 1 is a perspective view of a coupled state between a missile and a propulsion system according to the present invention.
Figure 2:
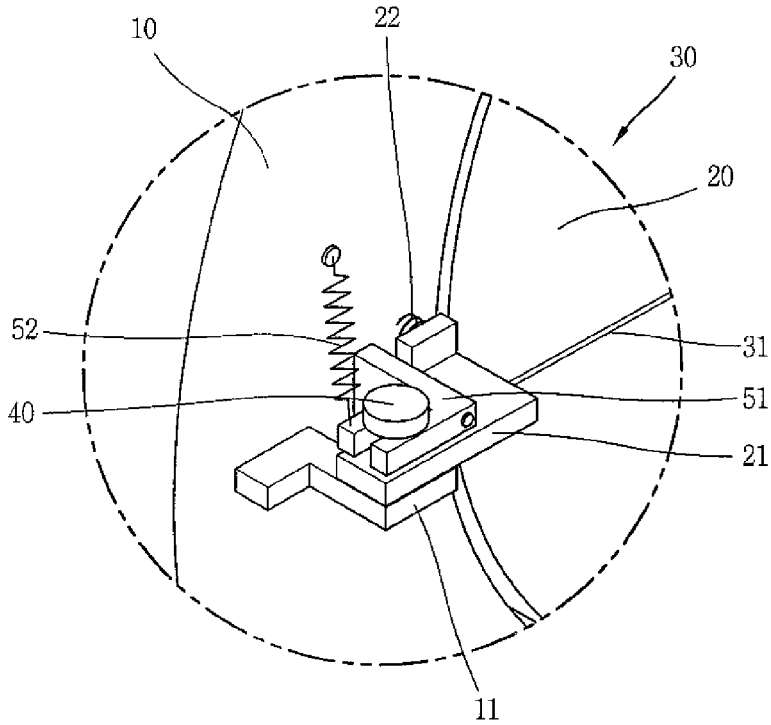
FIG. 2 is an enlarged view of part A of FIG. 1.

FIG. 1 is a perspective view of a coupled state between a missile and a propulsion system according to the present invention, and FIG. 2 is an enlarged view of part A of FIG. 1.

As shown in FIG. 1, a missile 10 is coupled to a propulsion system 20 for providing power for flying thereof and intended to be separated at a certain time. The propulsion system 20 serves to eject a missile from a launcher, such as a launching tube or launch platform, or to separate stages of a multistage missile. When the missile 10 is separated from the propulsion system 20, a main propellant mounted in the missile 10 is operated so as to propel the missile 10 to its target point.

Assemblies 30, which include a locking unit for fixing the propulsion system 20 to the missile 10 and an unlocking unit for unlocking the missile, are coupled to both sides of the propulsion system 20 by a string 31. The string 31 crosses a rear portion of the propulsion system 20 so as to be broken by heat of the propulsion system 20. The string 31 may be formed of a metal or plastic having a melting point as hard as being able to be melted by heat of the propulsion system 20. The string 31 may also be configured as a cable, a strip or in a shape having a certain part being thinner. When the string 31 is melted by heat of the propulsion system 20, the unlocking unit is operated such that the propulsion system 20 is separated from the missile 10.

Figure 3:
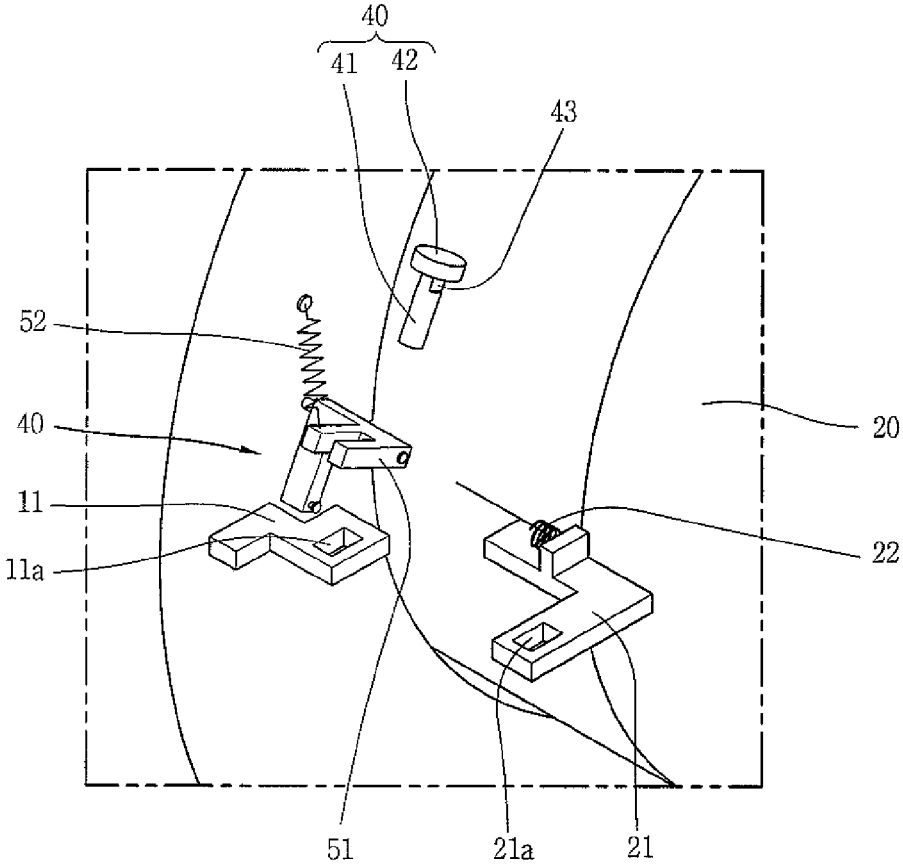
FIG. 3 is a disassembled view of a locking unit for fixing the missile and the propulsion system to each other.

FIG. 3 is a disassembled view of the locking unit for fixing the missile and the propulsion system to each other. The locking unit is configured as a pair at both sides of the propulsion system 20. Each locking unit 40 may include a missile fixing frame 11 formed at a rear portion of the missile 10, a propulsion system fixing frame 21 formed at the propulsion system 20, a fixing pin 41 for coupling the missile fixing frame 11 to the propulsion system fixing frame 21, and a first spring 22 supported between the missile 10 and the propulsion system 20 and disposed to apply an elastic force in a direction to separate the propulsion system 20.

The missile fixing frame 11 and the propulsion system fixing frame 21 are configured to be overlapped with each other. Pin holes 11*a* and 21*a* in which the fixing pin 41 is inserted are formed respectively at the corresponding overlapped sections between the missile fixing frame 11 and the propulsion system fixing frame 21.

The fixing pin 41 is provided with a pin body 41*a* and a head portion 41*b* having a diameter greater than that of the pin body 41*a*. The pin body 41*a* is inserted into the pin hole 21*a* of the propulsion system fixing frame 21 and the pin hole 11*a* of the missile fixing frame 11, so as to restrict the propulsion system 20. The fixing pin 41 may be disposed to be approximately perpendicular to the string 31. Also, the fixing pin 41 is rotated by a release latch 51 to be explained later, thus to release the coupled state between the missile fixing frame 11 and the propulsion system fixing frame 21. As shown in FIG. 3, the pin holes 11*a* and 21*a* are configured as long holes extending in a direction of the string 31 being disposed, so as not to interfere with the movement of the fixing pin 41.

The first spring 22 is transformed when the missile fixing frame 11 and the propulsion system fixing frame 21 are coupled by the fixing pin 41. Then, when the fixing pin 41 is separated (slipped out), the first spring 22 applies an elastic force to the propulsion system fixing frame 21 in a direction to separate the propulsion system 20. As shown in FIG. 3, the first spring 22 is exemplarily configured as a compression spring. Here, the first spring 22 may be implemented as varied types, such as a tension spring, a leaf spring and the like, to apply an elastic force to the same direction.

Figure 4:
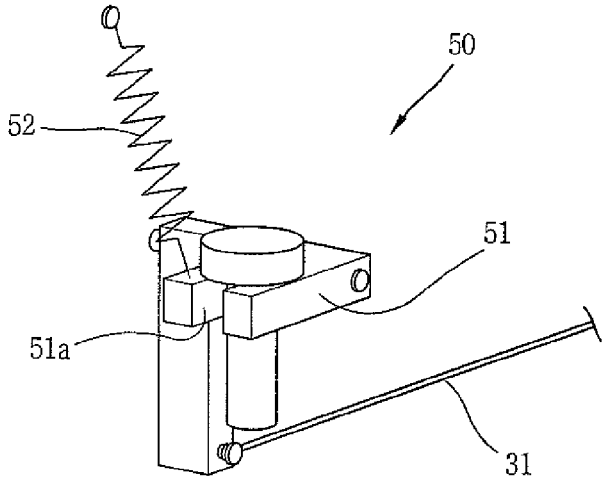
FIG. 4 is a perspective view only showing an unlocking unit according to the present invention.

FIG. 4 is a perspective view only showing the unlocking unit according to the present invention. As shown in FIG. 4, the unlocking unit 50 may include a release latch 51 having one side connected to the string 31, and a second spring 52 for applying an elastic force to the release latch 51.

The release latch 51 is installed to orbit with respect to the missile 10 so as to separate the fixing pin 41 out of the pin holes 11*a* and 21*a* when the string 31 is broken. A rotational shaft of the release latch 51 may be configured to be perpendicular to the string 31 and the fixing pin 41, respectively.

The second spring 52 is supported between the missile 10 and the release latch 51, and is installed to apply an elastic force to the release latch 51 in a direction to separate the fixing pin 41. As shown in FIG. 4, the second spring 52 is exemplarily configured as a tension spring. Here, the second spring 52 may be implemented as varied types, such as a tension spring, a leaf spring and the like, to apply an elastic force to the same direction.

However, still referring to FIG. 3, key grooves 42 may be recessed in the pin body 41*a* such that the fixing pin 41 can be restricted in a moving direction of the release latch 51. As shown in FIG. 4, the release latch 51 may have an open hole 51*a* in a shape of 'c' so as to be engaged with the key grooves 42 of the fixing pin 41. Accordingly, the fixing pin 41 cannot optionally be slipped out of the pin holes 11*a* and 21*a* of the missile fixing frame 11 and the propulsion system fixing frame 21 while handling the missile 10.

Figure 5A:
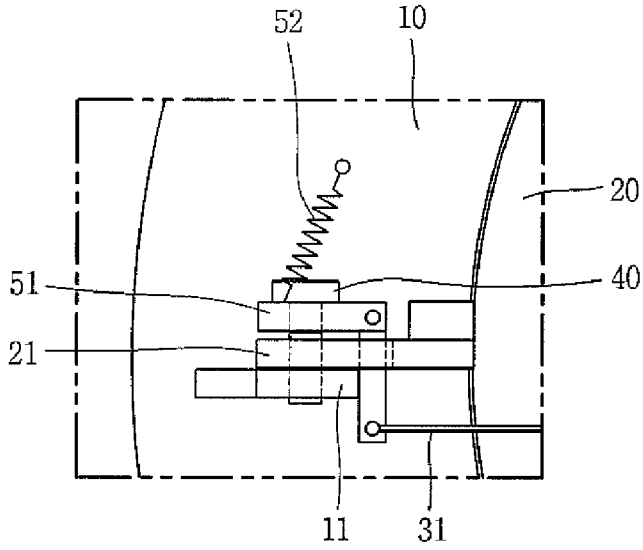
FIGS. 5A to 5C are views showing operational states of the unlocking unit according to the present invention.
Figure 5B:
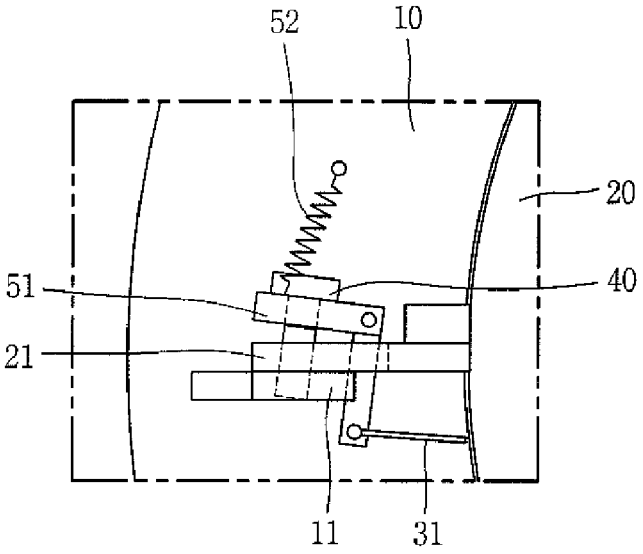
Figure 5C:
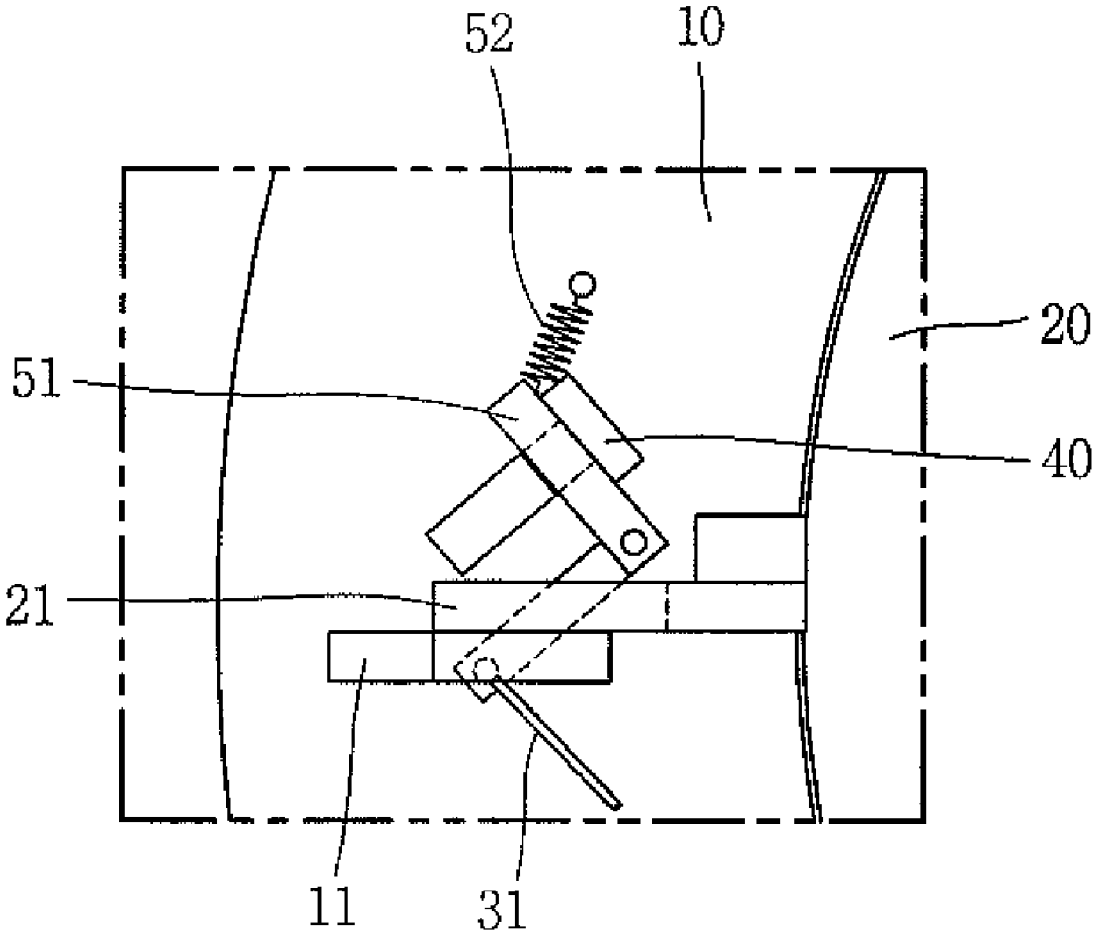

FIGS. 5A to 5C are views showing operational states of the unlocking unit according to the present invention. As shown in FIG. 5A, during the suspension of the missile 10, the string 31 and the second spring 52 keep their balance of forces. Thus, the fixing pin 41 maintains the coupled state between the missile fixing frame 11 and the propulsion system fixing frame 21.

As shown in FIGS. 5B and 5C, when the string 31 is broken by heat of the propulsion system 20, the release latch 51 is orbited only by the elastic force of the second spring 52, so as to apply a force toward the fixing pin 41 being slipped out. During this process, the fixing pin 41 may be orbited to be slipped out, and the pin holes 11*a* and 21*a* configured as the long holes support the separation of the fixing pin 41. In an alternative manner, a portion of the release latch 51 coming in contact with the head portion 41*b* of the fixing pin 41 may be circularly formed so as to allow the fixing pin 41 to be straightly lifted up along its coupled direction.

Figure 6A:
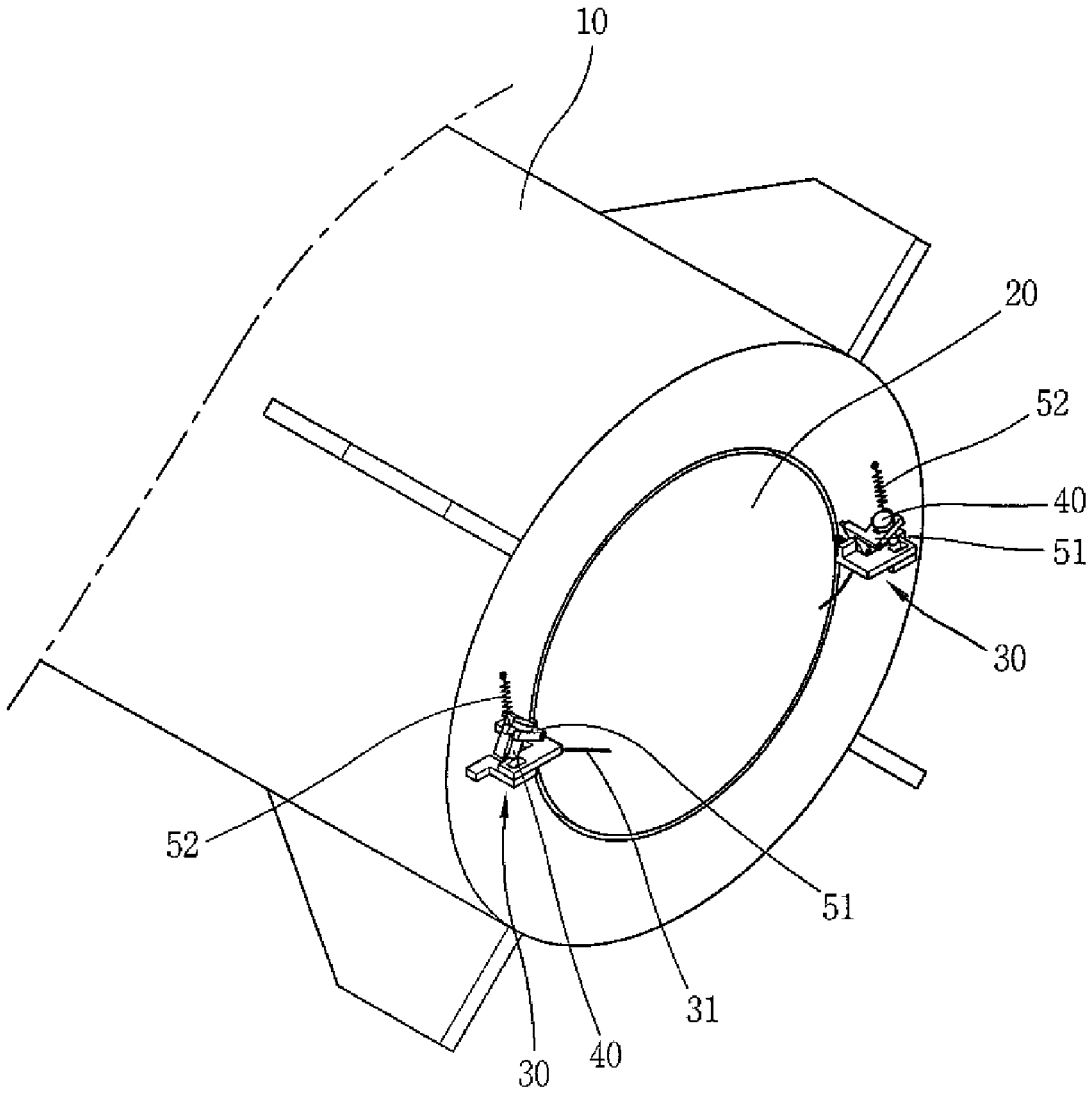
FIGS. 6A and 6B are views showing operational states after a spring is broken and during the separation of the propulsion system according to the present invention.
Figure 6B:
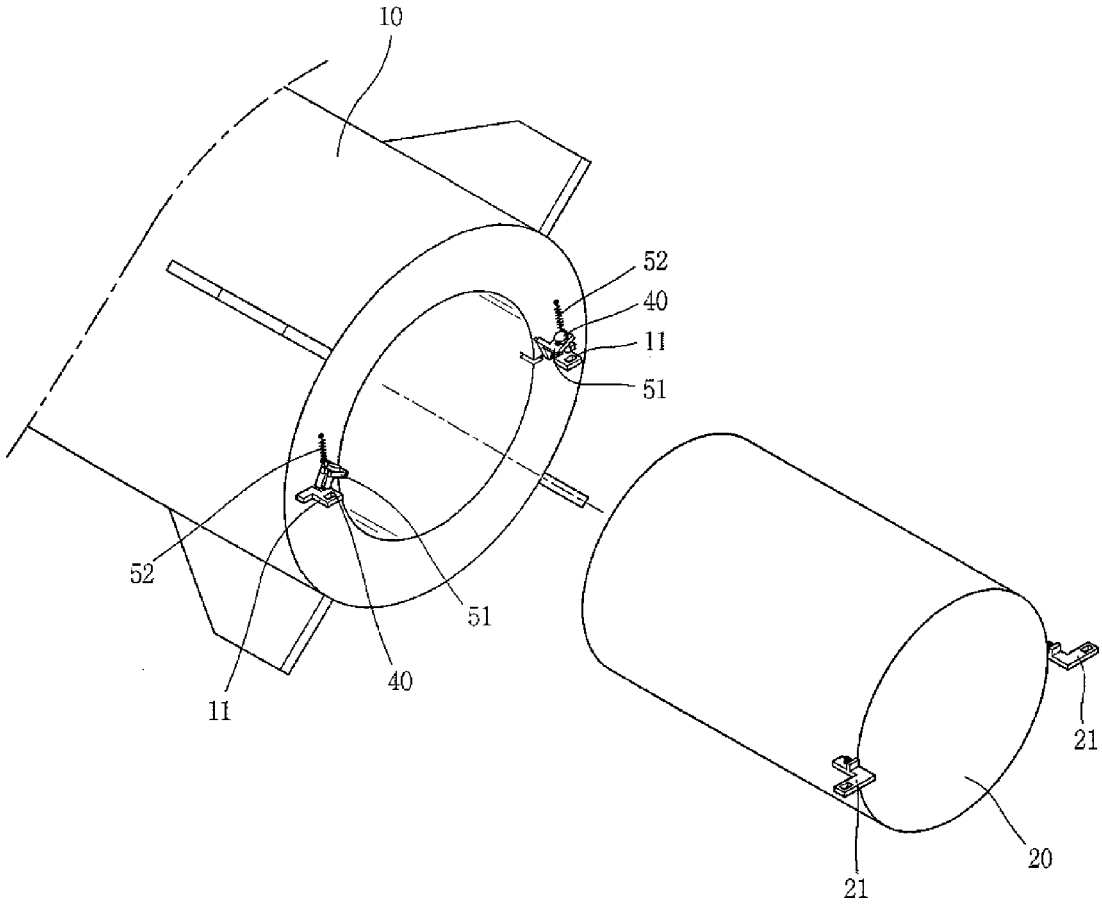

FIGS. 6A and 6B are views showing operational states after a string is broken and during the separation of the propulsion system according to the present invention. When the string 31 is broken by heat of the propulsion system 20, the release latches 51 at both sides are orbited by the elastic force of the second spring 52 so as to separate the fixing pin 41 out of the pin holes 11*a* and 21*a*.

After the fixing pin 41 is slipped out, the propulsion system fixing frame 12 is disassembled from the missile fixing frame 11, and the propulsion system 20 is then separated from the missile 10 by the elastic force of the first spring 22.

As mentioned above, the missile separation device according to the present invention can release a locked propulsion system by using a string which is broken by heat of the propulsion system, whereby the number of additional components of an unlocking system can be reduced as many as possible, so as to simplify the configuration of the apparatus, thereby guaranteeing an enhanced performance of the missile, an easy assembly of the missile, and a reduction of a fabricating cost.

In another aspect, unlike a pyrotechnic device used as an unlocking apparatus in the related art, the propulsion system is unlocked by its own heat. Accordingly, a problem of an operation environment, such as a great shock being in chance of occurring during the operation, cannot be caused, and also a separate fabricating cost can originally be cut down. In addition, unlike using a separate motor for generating a separation force in the existing unlocking devices, the unlocking device for the propulsion system of the missile according to the present invention can use the existing propulsion system as an igniter, and accordingly can generate a separation force using a mechanical mechanism, resulting in a cost reduction and an increase in efficiency.

Such unlocking device for the propulsion system of the missile can be applied to separation devices and coupling devices of various systems, in addition to research missiles and attach missiles.

As mentioned above, the missile separation device according to the present invention has been described with reference to the accompanying drawings, the present invention may not be limited to the preferred embodiments and the drawings. Also, at least one or more of the preferred embodiments can be combined, and variations and modifications can be derived by those skilled in the art within the scope of the present invention.

What is claimed is:

1. A missile separation device, comprising:

a locking unit configured to fix a propulsion system to a missile;

a string disposed to cross a rear portion of the propulsion system, configured to be cut off by heat of the propulsion system; and an unlocking unit configured to unlock the missile when the string is cut off, wherein the locking unit comprises:

a missile fixing frame formed at a rear portion of the missile;

a propulsion system fixing frame formed at the propulsion system;

a fixing pin disposed to be perpendicular to the string, configured to couple the missile fixing frame to the propulsion system fixing frame; and a first spring supported between the missile and the propulsion system and disposed to apply an elastic force to a direction to unlock the propulsion system, wherein the unlocking unit comprises:

a release latch having one side connected to the string, and installed to orbit with respect to the missile such that the fixing pin is slipped out of the pin holes when the string is cut off; and a second spring supported between the missile and the release latch, and configured to apply an elastic force to the release latch in the direction to separate the fixing pin, wherein the missile fixing frame and the propulsion system fixing frame are configured to be overlapped with each other, and pin holes, in which the fixing pin is inserted, are formed respectively in the corresponding overlapped sections between the missile fixing frame and the propulsion system fixing frame.

2. The device of claim 1, wherein the locking unit and the unlocking unit are formed as pairs at both sides of the propulsion system, and each unlocking unit is connected by the string.

3. The device of claim 1, wherein the pin holes are configured as long holes extending in a direction of the string being disposed.

4. The device of claim 1, wherein the string is formed of a metal or plastic having a melting point as hard as being able to be melted by heat of the propulsion system.

5. The device of claim 1, wherein a rotational shaft of the release shaft is configured to be perpendicular to the string and the fixing pin, respectively.

6. The device of claim 5, wherein the fixing pin is provided with a pin body and a head portion having a diameter greater than that of the pin body, and key grooves for restricting the fixing pin in a moving direction of the release latch are formed in the pin body.

7. The device of claim 6, wherein the release latch comprises an open hole formed in a shape of 'c' so as to be engaged with the key grooves of the fixing pin.

* * * * *